United States Patent [19]

Bateman, III

[11] Patent Number: 4,579,101

[45] Date of Patent: Apr. 1, 1986

[54] SWINGING ARM ARROW REST

[76] Inventor: Earle W. Bateman, III, P.O. Box 751, Fischer, Tex. 78623

[21] Appl. No.: 590,391

[22] Filed: Mar. 16, 1984

[51] Int. Cl.[4] ..... F41B 5/00; F41D 10/00

[52] U.S. Cl. ..... 124/41 A; 124/24 R

[58] Field of Search ..... 124/23 R, 41 A, 24 R

[56] References Cited

U.S. PATENT DOCUMENTS

| | | | |
|---|---|---|---|
| 3,504,659 | 4/1970 | Bubington | 124/24 R |
| 4,318,390 | 3/1982 | Trotter | 124/41 A |

*Primary Examiner*—Richard C. Pinkham
*Assistant Examiner*—Benjamin Layno
*Attorney, Agent, or Firm*—Fulbright & Jaworski

[57] ABSTRACT

An arrow rest adapted to be connected to either side of a bow. A swinging arm is pivotally supported from a body, in one position the swinging arm supports the arrow, and in a second position the swinging arm is movable away from the arrow. The arm is releasably locked by a flexible door which is spring biased to a position locking the arm. The door is actuated by the release of the arrow which releases the arm. The arm is moved out of the way of the arrow by a spring. The arm may be held in two positions for use by either right handed or left handed archers such that the arrow rest may be mounted to either side of the bow.

4 Claims, 12 Drawing Figures

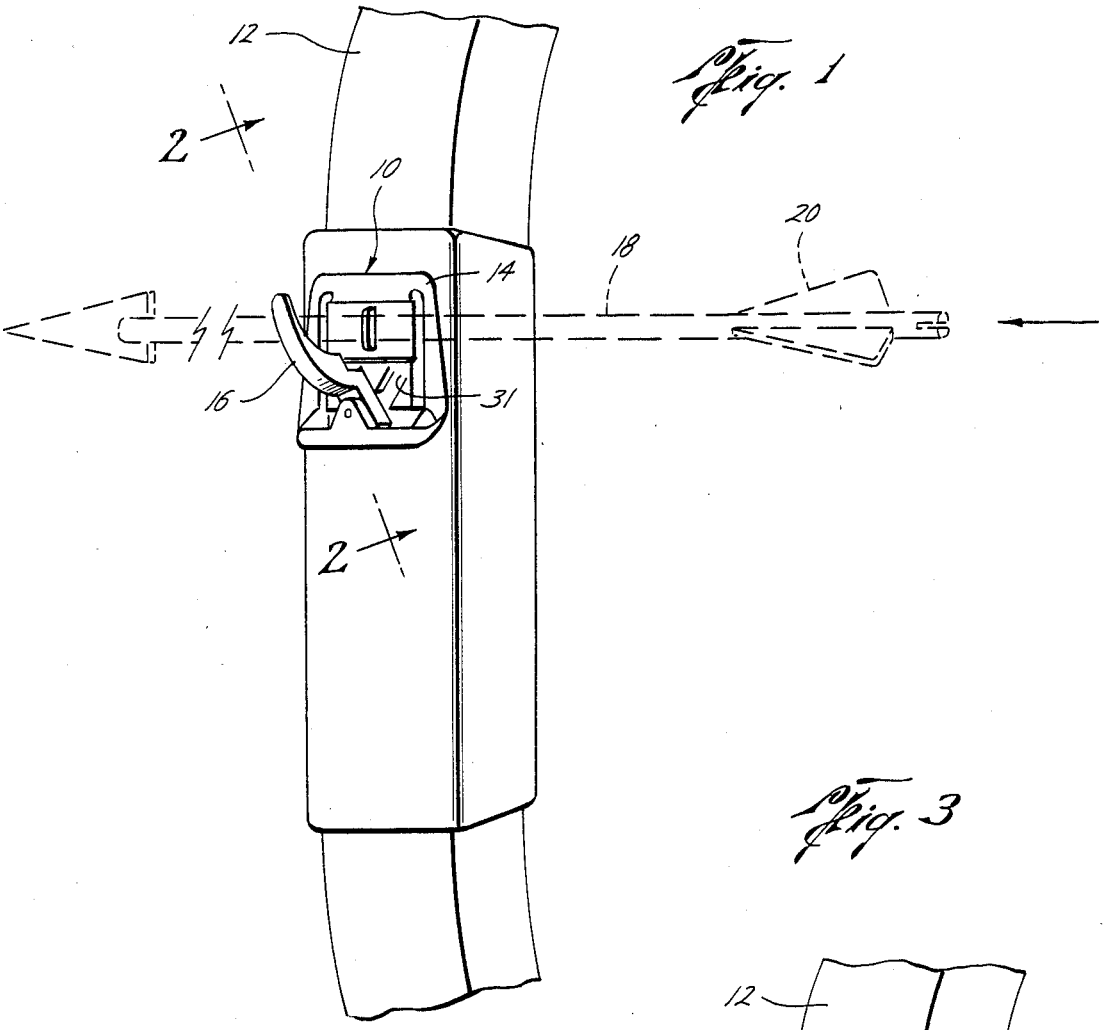
Fig. 1
Fig. 3
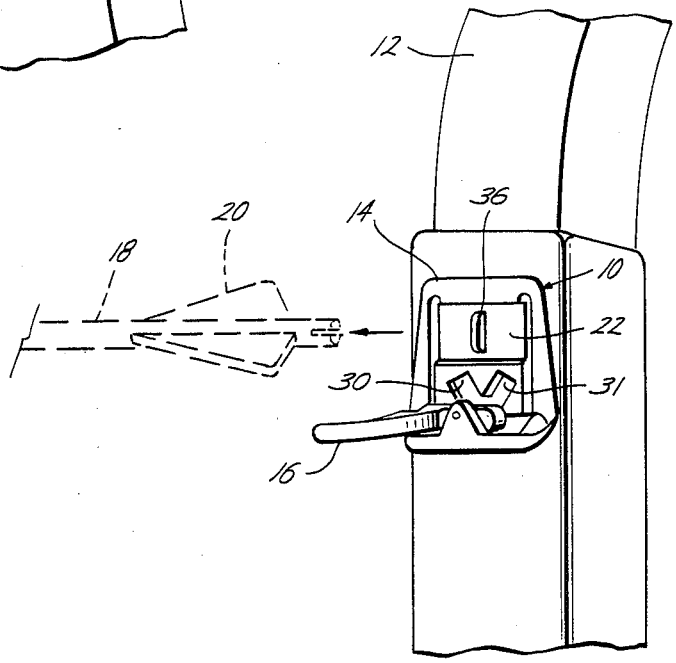
Fig. 2
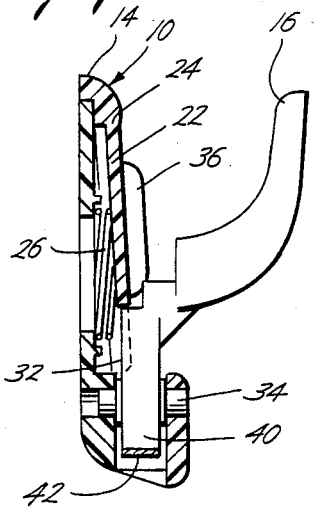

SWINGING ARM ARROW REST

BACKGROUND OF THE INVENTION

Arrow rests are used to provide an archer with a device for holding the arrow in place on the archery bow and provide a guide for promoting accuracy of the arrow. However, many arrow rests of the prior art engage the feathers or fletching which deflects the arrow from its true course and in addition cause wear or damage to the feathers or fletching.

The present invention is directed to an improved arrow rest having a swinging arm which initially holds the arrow while it is being drawn, aimed and released, but which moves out of the way as the arrow is released to reduce damage to the fletching and reduce interference with the trajectory of the arrow.

SUMMARY

The present invention is directed to an arrow rest for attachment to a bow having a body adapted to be connected to the bow with a swinging arm pivotally supported from the body for supporting the arrow in one position and movable away from the arrow. Coacting releasable locking means are provided on the body and the arm for holding the arm locked in the one position, and resilient means on the body yieldably urge the releasable locking means into engagement. Releasable means on the body is engagable and actuated by an arrow for releasing the locking means for allowing rotation of the swinging arm away from the arrow.

A still further object is the provision of resilient means on the body engaging the arm and yieldably urging the arm away from the arrow for quickly moving the arm out of the way of the fletching as the arrow is released.

Yet a still further object of the present invention is wherein the resilient means on the body includes a movable door with spring means urging the door towards the arm for engaging the coacting releasing locking means between the door and the arm.

Still a further object is wherein the door includes a raised pressure point for engagement by an arrow for moving the door and releasing the locking means.

Still a further object of the present invention is the provision of releasable locking means on both sides of the pressure point for locking the arm whereby the arrow rest may be used on either side of the bow to accommodate either a left-handed or a right-handed archer.

Still a further object of the present invention is wherein the swinging arm includes an extended tang from the pivot support and the resilient means engaging the arm is a leaf spring engaging the tang for moving the swinging arm away from the arrow from its locked position as the locking means is released.

Other and further objects, features and advantages will be apparent from the following description of a presently preferred embodiment of the invention, given for the purpose of disclosure and taken in conjunction with the accompanying drawings.

BRIEF DESCRIPTION OF THE DRAWINGS

FIG. 1 is a fragmentary perspective view of a bow with the arrow rest of the present invention positioned on the side of the bow and supporting an arrow shown in dotted outline, FIG. 2 is an enlarged cross-sectional view taken along the line 2—2 of FIG. 1, FIG. 3 is a view similar to FIG. 1 showing the arrow rest in the released position.

DESCRIPTION OF THE PREFERRED EMBODIMENT

Figure 4:
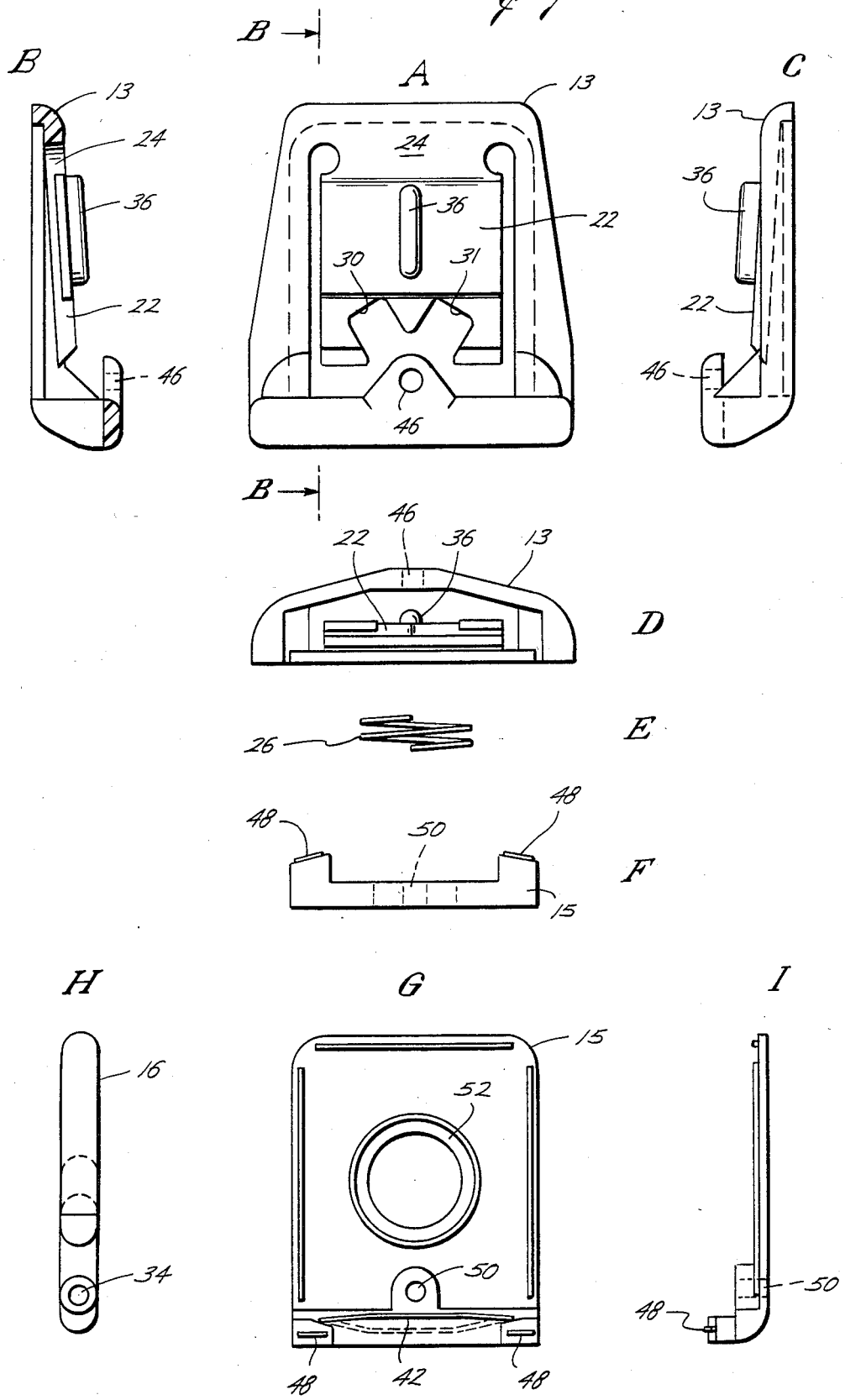
FIG. 4A is an enlarged elevational view of one portion of the body or housing.
FIG. 4B is a cross-sectional view taken along the line B—B of FIG. 4A.
FIG. 4C is a side view of the body portion in FIG. 4A, FIGS. 4D, 4E and 4F are enlarged top elevational exploded views of the body or housing of the present invention.
FIG. 4G is an enlarged elevational view of the back portion of the body or housing of the present invention.
FIG. 4H is an enlarged elevational view of the swinging arm of the arrow rest of the present invention.
FIG. 4I is a side view of the body portion of FIG. 4G.

Referring now to the drawings, and particularly to FIGS. 1∝3, the arrow rest of the present invention is generally indicated by the reference numeral 10 and may be positioned on either side of an archery bow 2, here shown as being on the left side for use by a right-handed archer. The rest 10 generally includes a body or housing 14 adapted to be suitably connected to the bow 12 by any suitable means such as glue and a swinging arm 16 pivotally supported from the body 14. The arm 16 is adpated to be moved into a first position, such as shown in FIG. 1, for supporting and guiding an arrow 18 shown in dotted outline, but after the arrow 18 is released, the arm 16 moves away from the arrow, as best seen in FIG. 3, whereby the arm 16 will not engage the feathers or fletching 20 and therefore will not undesirably deflect the arrow or cause wear or damage to the fletching 20.

The body 14 includes a door 22 pivotally supported at a hinge 24 for movement toward and away from the arm 16 and is yieldably urged towards the arm 16 by resilient means such as a coil spring 26.

Coacting releasable locking means are provided between the body 14 and the arm 16 for holding the arm 16 in one position, such as shown in FIG. 1. The coacting releasing locking means may include an indentation or groove 30 (FIG. 3) on one of the body 14 or arm 16, such as the door 22, and a projection or shoulder 32 (FIG. 2) on the other, such as on the arm 16. The arm 16 is manually rotated about its pivot rod 34 to the position shown in FIG. 1 bringing the shoulder 32 into registry with the groove 30. The spring 26 will urge the door 22 about its flexible hinge 24 outwardly toward the arm 16 to releasably hold the shoulder 32 and groove 30 in engagement thereby holding the arm 16 in the position shown in FIG. 1 for supporting an arrow 18. When the arrow is released, its shaft will create a force on the door 22 and preferably on a raised pressure point 36 to force the door 22 inwardly overcoming the spring 26 thereby releasing the locking engagement of the shoulder 32 with the groove 30.

While it is possible for the arm 16 to rotate forward on its pivot 34 after it is released due to the forward movement of the shaft of the arrow 18, it is preferable to provide a snap and positive action to move the swinging arm 16 out of the way of the arrow 18. Thus, the swinging arm 16 includes an extension or tang 40 (FIG. 2) extending below the pivot 34 which engages a resilient means such as a leaf spring 42. The tang 40 comes in contact with and overcomes the leaf spring 42 when the shoulder 32 is moved into position to engage the groove 30. Upon release of the shoulder 32 from the groove 30, the leaf spring 42 engages the end of the tang 30 to rotate the swinging arm 16 about the pivot point 34 and away from the arrow 18.

While the above description has described the swinging arm arrow rest 10 of the present invention as applied in use on the left side of the bow 2 for use by a right-handed archer, the arrow rest 10 can similarly be used by placing it on the right-hand side of a bow for use by a left-handed archer. In such an event, a second groove 31 is provided in the door 22 for acting as the releasable locking means with the shoulder 32 of the swinging arm 16. In either use, the swinging arm is manually moved into position engaging either the groove 30 or the groove 31 and upon actuation of the door 22 by the pressure point 36 caused by the force of the released arrow 18, the swinging arm 16 is released and is moved forward by the action of the leaf spring 42.

While the parts of the arrow rest 10 may be made of any suitable materials, it is satisfactory to make the various materials out of molded plastic, such as acetal resin. Referring now to FIG. 4, the various molded components are best seen. Referring to FIGS. 4A, B and C, the front half 13 of the body 12 is shown wherein the body portion 13 includes a door 22 supported from the body 13 by a flexible hinge 24. The door 22 also includes the raised pressure point 36 and the indentation or grooves 30 and 31 for coacting with the shoulder 32 and locking the swinging arm. The body portion 13 also includes a hub 46 for supporting one end of the pivot rod 34 of the swinging arm 16.

Referring to FIGS. 4D, E and F, an exploded view of the front body portion and the rear body portion 15 is shown in which the rear body portion 15 includes ears 48 on either side for glueing to the body portion 13 and the spring 26 which is positioned between the body portions 13 and 15 for yieldably urging the door 22 outwardly toward the arm 16. It is noted that the back body portion 16 includes a hub 50 for engaging and supporting the other end of the pivot 34 of the swinging arm 16.

FIGS. 4G and I show other views of the back portion 15 of the body 12. The back portion 15 may include a circular recess 52 for holding the spring 26.

FIG. 4H shows a side view of the swinging arm 16 wherein the pivot rod 34 engages the hub openings 46 and 50 of the front portion 13 and rear portion 5 of the body 12 before they are secured together. Also, the leaf spring 42 (FIG. 4G and the coil spring 26 are positioned therein between the body portions 13 and 15.

In use, the arrow rest 10 is secured on the appropriate side of the bow 12 depending upon the archer. The swinging arm 16 is moved into the first or locking position by manually rotating the swinging arm 16 to engage the releasable locking means such as the shoulder 32 and groove 30 whereby the swinging arm 16 is positioned in the forward direction for a right-handed archer. With the arm 16 locked in position, an arrow may be placed in position and securely held therein to provide the necessary support and guidance of the arrow 18 prior to and at the time of release. The force of the released arrow acts against the raised pressure point 36 to press the door inwardly to release the arm 16 which then is rotated by spring 42 forwardly and downwardly out of engagement with the arrow 18 so as to avoid contacting the feathers or fletching 20. Thus the arrow rest 10 supports the arrow and provides it initial guidance but avoids deflecting it from its path of travel by contacting the fletching 20 and wearing or damaging the fletching 20. The arm 16 must then again be lifted to a locked position for the next shot.

The present invention, therefore, is well adapted to carry out the objects and attain the ends and advantages mentioned as well as others inherent therein. While a presently preferred embodiment of the invention is given for the purpose of disclosure, numerous changes in the details of construction, and arrangement of parts may be made which will readily suggest themselves to those skilled in the art and which are encompassed within the spirit of the invention and the scope of the appended claims.

What is claimed is:

1. An arrow rest for attachment to a bow comprising,
a body adapted to be connected to a bow,
a swinging arm pivotally supported from said body for supporting an arrow in one position and movable away from the arrow,
coacting releasable locking means on the body and said arm,
resilient means on the body for yieldably urging said releasable locking means transversely to said body and said arms into engagement for holding said arm in a locked position,
releasing means on the body connected to the releasable locking means, said releasing means engagable by an arrow for moving the releasable locking means on the body transversely to the body for releasing the locking means for allowing rotation of the swinging arm away from and out of contact with the arrow,
said releasable locking means on the body including, a movable door, and said resilient means includes, spring means urging said door towards said arm,
said door includes,
a raised pressure point for engagement by an arrow for moving said door, and
releasable locking means on both sides of the pressure point for locking said arm whereby the rest may be used on either side of the bow.

2. An arrow rest for attachment to a bow comprising,
a body adapted to be connected to a bow,
a swinging arm pivotally supported from said body for supporting an arrow in one position and movable away from and out of contact with the arrow,
said body includes a door pivotally supported for transverse movement towards said arm, and spring means urging said door towards said arm,
coacting releasable locking means on the door and said arm which are engaged by the spring moving the door towards said arm,
releasing means on the door actuated by engagement of an arrow for moving said door away from said arm and releasing said arm,
resilient means engaging said arm and yieldably urging said arm away from the arrow,
the releasing means includes a raised pressure point for engagement by an arrow, and
the releasable locking means include means on both sides of the pressure point whereby the rest may be used on either side of the bow.

3. An arrow rest for attachment to a bow comprising,
a body adapted to be connected to a bow, a swinging arm pivotally supported from said body for supporting an arrow in one position and movable away from and out of contact with the arrow, said body includes a door pivotally supported for transverse movement towards said arm, and spring means urging said door towards said arm, coacting releasable locking means on the door and said arm which are engaged by the spring moving the door towards said arm, releasing means on the door actuated by engagement of an arrow for moving said door away from said arm and releasing said arm, resilient means engaging said arm and yieldably urging said arm away from the arrow, and the arm includes an extended tang from the pivot support, and said resilient means engaging said arm includes a leaf spring engaging the extended tang.

4. An arrow rest for attachment to a bow comprising, a body adapted to be connected to a bow, a swinging arm pivotally supported from said body, a pivot rod pivotally supporting said swinging arm and perpendicular to the body, said swinging arm supporting an arrow when the arm is in a vertical position and is movable away from the arrow whereby the arm is capable of being pivoted downwardly in two different directions such that the arrow rest may be used on either side of the bow, said body includes a door pivotally supported for transverse movement towards said arm, spring means urging said door towards said arm, coacting releasable locking means on the arm and on opposite sides of the door which are engaged by the spring moving the door towards said arm whereby the rest may be used on either side of the bow, releasing means on the door actuated by engagement of an arrow moving said door away from said arm and releasing said arm, said arm includes an extended tang positioned below the pivot support, and a leaf spring engaging the extended tang for yieldably urging said arm away from the arrow.

* * * * *